US006043744A

United States Patent [19]

Matsudaira

[11] Patent Number: 6,043,744

[45] Date of Patent: Mar. 28, 2000

[54] ANTITHEFT SYSTEM

[75] Inventor: Shinji Matsudaira, Higashiosaka, Japan

[73] Assignees: Sanyo Electric Co., Ltd., Moriguchi; Sanyo Electronic Components Co., Ltd., Daito, both of Japan

[21] Appl. No.: 09/131,876

[22] Filed: Aug. 10, 1998

[30] Foreign Application Priority Data

Aug. 11, 1997 [JP] Japan ..... 9-216610

[51] Int. Cl.[7] ..... G08B 13/14

[52] U.S. Cl. ..... 340/571; 340/572.1; 340/572.4

[58] Field of Search ..... 340/571, 572.1, 340/531, 506, 825.36, 825.49, 568.1, 568.2, 572.4, 572.5, 572.7, 572.9

[56] References Cited

U.S. PATENT DOCUMENTS 5,245,317 9/1993 Chidley et al. ..... 340/571

5,726,627 3/1998 Kane et al. ..... 340/571

5,808,548 9/1998 Sasagawa et al. ..... 340/572.1

*Primary Examiner*—Benjamin C. Lee

*Assistant Examiner*—Van T. Trieu

*Attorney, Agent, or Firm*—Nikaido, Marmelstein, Murray & Oram, LLP

[57] ABSTRACT

An antitheft system embodying the invention comprises an alarm unit 2 attached to a commodity for producing an alarm on receiving a detection signal or an alarm activating signal while stopping the alarm on receiving an alarm stopping signal, and a signal generator provided on a cashier's counter for producing alarm activating signals and alarm stopping signals alternately. When the commodity is handed by the customer to the clerk at the cashier's counter, with the alarm unit 2 attached to the commodity, the alarm unit 2 intermittently produces an alarm on receiving alarm activating signals and alarm stopping signals alternately, thereby enabling the clerk to reliably recognize that the alarm unit 2 is attached to the commodity. When the clerk thereafter removes the alarm unit 2 from the commodity, the production of alarm is forcibly ceased.

12 Claims, 8 Drawing Sheets

ANTITHEFT SYSTEM

FIELD OF THE INVENTION

The present invention relates to antitheft systems for protecting merchandise on display in stores from unlawful acts such as shoplifting, and more particularly to an antitheft system which is adapted to produce an alarm to enable store clerks to recognize that a commodity and an alarm unit are connected to each other.

BACKGROUND OF THE INVENTION

FIG. 9 shows an antitheft system conventionally used in stores wherein commodities such as compact disk cassettes and magnetic tape cassettes are on display for sale, to protect these articles from shoplifting or like illegal acts.

The antitheft system comprises an antitheft gate 3 installed in the vicinity of an exit 30 of the store, and an alarm unit 2 attached to a commodity 5. The antitheft gate 3 has a circuit board 31 and a transmitting antenna (not shown). The circuit board 31 is provided with a transmitting circuit (not shown) for producing an alarm activating signal for the alarm unit 2.

With reference to FIG. 10, the alarm unit 2 comprises a buzzer 21, circuit board 27, battery (not shown), etc. which are housed in a casing 20. The casing 20 has a surface formed with sound emitting holes 28 and an alarm actuating switch piece 22. The buzzer 21 has its operation controlled by the circuit board 27 and is adapted to produce an alarm when the unit 2 is removed from the commodity or when the unit 2 passes by the antitheft gate 3.

The commodity is placed on display in the store, with the alarm unit 2 attached thereto. When selling the commodity to the customer, the clerk holds the buzzer 21 out of operation by s ending a specified signal to the circuit board 27 of the alarm unit 2, then removes the unit 2 from the commodity and hands the commodity to the customer in exchange for money.

If the customer wrongfully removes the alarm unit 2 from the commodity 5, the switch piece 22 is turned off to actuate the buzzer 21. Further if the customer acts to unlawfully bring the commodity 5 out of the store along with the alarm unit 2, the circuit board 27 of the alarm unit 2 receives an alarm activating signal from the transmitting antenna of the antitheft gate 3 to turn on the buzzer 21.

However, the antitheft system described involves the likelihood that when selling the commodity 5, the clerk will inadvertently hand the commodity 5 to the customer without removing the alarm unit 2 therefrom. A problem then arises in that the buzzer 21 goes on when t he customer passes by the antitheft gate 3 although purchasing the commodity lawfully, giving discomfort to the customer.

SUMMARY OF THE INVENTION

An object of the present invention is to provide an antitheft system, for example, for use in stores which enables the clerk to reliably recognize that the alarm unit thereof is connected to a commodity.

The present invention provides an antitheft system comprising an alarm unit to be connected to an article to be prevented from being stolen, and a signal generator for producing a notifying signal, the alarm unit comprising detector means for detecting disconnection of the unit from the article to produce a detection signal, means for receiving the notifying signal, alarm means for producing an alarm, and control means for operating the alarm means upon receiving the detection signal while operating the alarm means upon receiving the notifying signal from the receiving means and thereafter nullifying the detection signal and the notifying signal.

When the antitheft system is to be used, for example, in stores, the commodities to be prevented from being stolen are placed on display, with the alarm unit connected to each of the commodities. On the other hand, the signal generator is provided on a cashier's counter where the clerk hands the commodity to the customer in exchange for money.

When the commodity as removed from the display table is wrongfully disconnected from the alarm unit, the detector means produces a detection signal, whereupon the control means of the alarm unit operates the alarm means in response to the detection signal, thereby causing the alarm means to give an alarm and notifying the people in the neighborhood of the unlawful act.

When the customer hands the commodity to the clerk at the cashier's counter with the alarm unit connected to the commodity, the receiving means of the alarm unit receives a notifying signal from the signal generator. Upon receiving the notifying signal from the receiving means, the control means operates the alarm means and thereafter nullifies the detection signal and notifying signal. Consequently, the alarm unit forcibly stops producing the alarm after the alarm has been emitted by the alarm means although the detection signal and notifying signal are input.

The alarm thus produced by the alarm unit in the hands of the clerk enables the clerk to recognize that the commodity and the alarm unit are held connected to each other. The alarm thus produced in the immediate vicinity of the clerk gives little or no discomfort to the customer.

After producing the alarm, the alarm unit forcibly stops the production of alarm, so that the antitheft system described is free of the drawback that an unnecessary alarm is continuously produced.

Stated more specifically, the invention provides a first antitheft system which comprises an alarm unit to be connected to an article to be prevented from being stolen, and a signal generator for alternately producing alarm activating signals and alarm stopping signals.

The alarm unit comprises detector means, alarm means, means for receiving the alarm activating signal and the alarm stopping signal, alarm control means for operating the alarm means upon receiving a detection signal or upon receiving the alarm activating signal from the receiving means while bringing the alarm means out of operation upon receiving the alarm stopping signal from the receiving means, and nullifying means operable upon the alarm control means receiving the detection signal and one of the alarm activating signal and the alarm stopping signal to nullify the subsequent detection signal and alarm activating signal.

When the antitheft system is used in stores, commodities are placed on display, with the alarm unit connected to each of the commodities. On the other hand, the signal generator is provided on a cashier's counter.

When the commodity as removed from the display table is wrongfully disconnected from the alarm unit, the detector means produces a detection signal, whereupon the alarm control means of the alarm unit operates the alarm means in response to the detection signal, thereby causing the alarm means to give an alarm and notifying the people in the neighborhood of the unlawful act.

When the customer hands the commodity to the clerk at the cashier's counter with the alarm unit connected to the commodity, the receiving means of the alarm unit receives alarm activating signals and alarm stopping signals alternately from the signal generator.

The alarm control means of the alarm unit operates the alarm means upon receiving the alarm activating signal from the receiving means while bringing the alarm means out of operation upon receiving the alarm stopping signal from the receiving means. Repetition of this procedure causes the alarm means to intermittently produce an alarm, enabling the clerk to reliably recognize that the commodity and the alarm unit are connected to each other.

When the clerk subsequently disconnects the alarm unit from the commodity, with the receiving means of the unit receiving alarm activating and alarm stopping signals alternately, the detector means produces a detection signal, with the result that the alarm control means receives the alarm activating signal or alarm stopping signal from the receiving means in addition to the detection signal. Recognizing this state, the nullifying means nullifies the subsequent detection signal and alarm activating signal. Consequently, the alarm unit forcibly stops producing the alarm despite the input of detection signal and alarm activating signal.

With the first antitheft system described above, the disconnection of the alarm unit from the commodity by the clerk at the cashier's counter precludes the emission of alarm, obviating the drawback that a useless alarm will be continuously produced.

Stated more specifically, the nullifying means nullifies the subsequent detection signal and alarm activating signal upon receiving both the detection signal and the alarm stopping signal.

When the alarm unit thus adapted is disconnected from the commodity by the clerk during the period in which the alarm activating signal is being produced, and when the alarm control means subsequently receives an alarm stopping signal from the receiving means, the control means receives both the detection signal and the alarm stopping signal, with the result that the nullification by the nullifying means forcibly ceases the subsequent production of alarm.

Further when the alarm unit is disconnected from the commodity by the clerk during the period in which the alarm stopping signal is being produced, the alarm control means receives both the detection signal and the alarm stopping signal at this time, with the result that the nullification by the nullifying means forcibly ceases the subsequent production of alarm.

Stated more specifically, the on period of the alarm stopping signal is made longer than the on period of the alarm activating signal.

When the alarm is thus produced intermittently, the period of alarm production by the alarm activating signal becomes shorter than the period of alarm absence by the alarm stopping signal, consequently giving a suitable notifying effect to the clerk.

Stated more specifically, the nullifying means cancels the nullification of the detection signal and the alarm activating signal when the detection signal remains off for more than a specified period of time after the nullification of the detection signal and the alarm activating signal.

In the case where the alarm unit thus specifically constructed and forcibly brought out of the alarm producing operation by the foregoing procedure by the clerk (reset state) is to be restored to the usual state for an alarming operation (set state), the alarm unit is connected to a commodity. This renders the detection signal off, and when the detection signal remains off for more than the specified period of time, the nullification by the nullifying means is canceled, whereby the alarm unit is set in condition for producing an alarm in response to a detection signal or alarm activating signal.

Stated more specifically, the system further comprises a transmitter provided within an alarming area for transmitting the alarm activating signal to the alarm unit when the unit is being passed through the alarming area.

More specifically, the transmitter is provided in the vicinity of an exit of the store.

When the customer passes through the alarming area in the vicinity of the store exit in an attempt to wrongfully bring a commodity out of the store, the alarm unit connected to the commodity produces an alarm on receiving the alarm activating signal, thus notifying the clerk of the wrongful act.

Specifically stated, the present invention provides a second antitheft system comprising an alarm unit to be connected to an article to be prevented from being stolen, and a signal generator for producing an intermittent sound generating signal.

The alarm unit comprises detector means, alarm means, means for receiving the intermittent sound generating signal, alarm control means for continuously operating the alarm means upon receiving a detection signal while intermittently operating the alarm means upon receiving the intermittent sound generating signal from the receiving means, and nullifying means operable upon the alarm control means receiving both the detection signal and the intermittent sound generating signal to nullify the subsequent detection signal and intermittent sound generating signal.

When the second antitheft system is used in stores, commodities are placed on display, with the alarm unit connected to each of the commodities. On the other hand, the signal generator is provided on a cashier's counter.

When the commodity as removed from the display table is wrongfully disconnected from the alarm unit, the detector means produces a detection signal, whereupon the alarm control means of the alarm unit continuously operates the alarm means in response to the detection signal, thereby causing the alarm means to continuously give an alarm and notifying the people in the neighborhood of the unlawful act.

When the customer hands the commodity to the clerk at the cashier's counter with the alarm unit connected to the commodity, the receiving means of the alarm unit receives an intermittent sound generating signal from the signal generator. The alarm control means intermittently operates the alarm means upon receiving the intermittent sound generating signal from the receiving means, whereby an alarm is intermittently emitted by the alarm means, enabling the clerk to reliably recognize that the commodity and the alarm unit are connected to each other.

When the clerk subsequently disconnects the alarm unit from the commodity, with the receiving means of the unit receiving the intermittent sound generating signal, the detector means produces a detection signal, with the result that the alarm control means receives both the intermittent sound generating signal and the detection signal. Recognizing this state, the nullifying means nullifies the subsequent detection signal and intermittent sound generating signal. Consequently, the alarm unit forcibly stops producing the alarm despite the input of detection signal and intermittent sound generating signal.

With the second antitheft system described above, the disconnection of the alarm unit from the commodity by the clerk at the cashier's counter forcibly precludes the emission of alarm, obviating the drawback that a useless alarm will be continuously produced.

Stated more specifically, the present invention provides a third antitheft system which comprises an alarm unit to be connected to an article to be prevented from being stolen, and a signal generator for producing a short sound generating signal.

The alarm unit comprises detector means, alarm means, means for receiving the short sound generating signal, alarm control means for operating the alarm means upon receiving a detection signal, and nullifying means for operating the alarm means only for a predetermined period of time upon receiving the short sound generating signal from the receiving means and thereafter nullifying the subsequent detection signal and short sound generating signal.

When the third antitheft system is used in stores, commodities are placed on display, with the alarm unit connected to each of the commodities. On the other hand, the signal generator is provided on a cashier's counter.

When the commodity as removed from the display table is wrongfully disconnected from the alarm unit, the detector means produces a detection signal, whereupon the alarm control means of the alarm unit operates the alarm means in response to the detection signal, thereby causing the alarm means to give an alarm and notifying the people in the neighborhood of the unlawful act.

When the customer hands the commodity to the clerk at the cashier's counter with the alarm unit connected to the commodity, the receiving means of the alarm unit receives a short sound generating signal from the signal generator. The nullifying means operates the alarm means only for a predetermined period of time, e.g., for 0.1 to 1.0 sec, upon receiving the short sound generating signal from the receiving means, and thereafter nullifies the subsequent short sound generating signal and detection signal. As a result, the alarm means produces an alarm only for a short period of time and thereafter forcibly stops producing the alarm despite the input of detection signal and short sound generating signal.

With the third antitheft system described above, an alarm is given for a short period of time only, enabling the clerk to recognize that the commodity and the alarm unit are connected to each other. Further regardless of whether the alarm unit is disconnected from the commodity, the unit emits the alarm merely for a short period of time as positioned in the hands of the clerk. The unit is therefore diminished in power consumption, rendering the battery incorporated therein serviceable for a longer period.

The antitheft system of the present invention produces an alarm which notifies that the article to be prevented from being stolen and the alarm unit are connected to each other. When the system is used, for example, in stores, the alarm unit connected to the commodity is reliably disconnected therefrom at the cashier's counter. It is therefore unlikely that the rightful customer will be given an alarm when passing by the antitheft gate.

DETAILED DESCRIPTION OF EMBODIMENTS

The present invention will be described below in detail with reference to three embodiments.

First Embodiment

Figure 9:
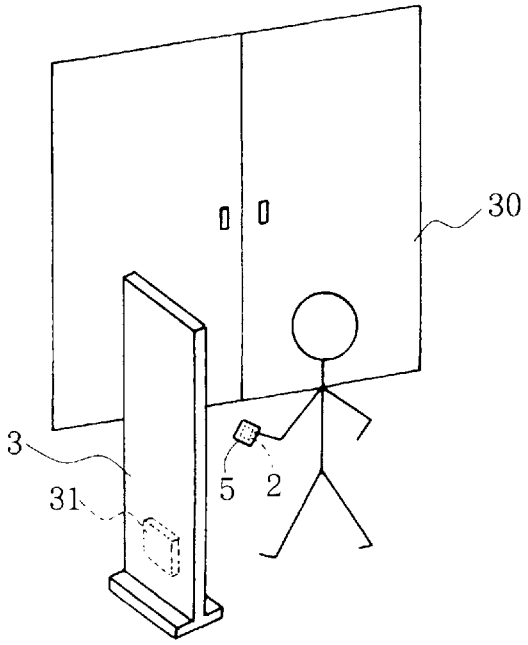
FIG. 9 PRIOR ART
FIG. 9 is a perspective view showing an antitheft gate installed in the vicinity of an exit of a store.
Figure 10:
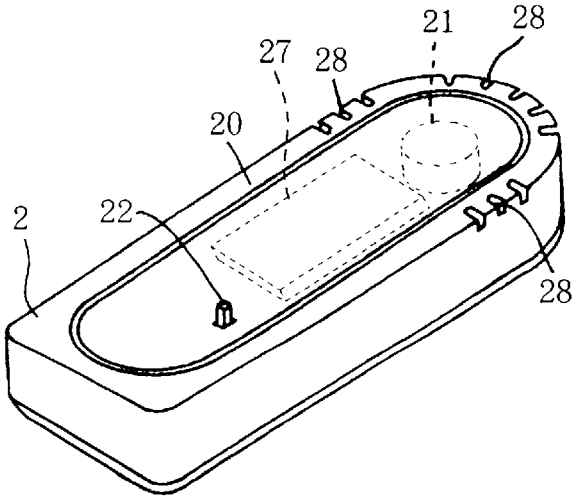
FIG. 10 PRIOR ART
FIG. 10 is a perspective view of a conventional alarm unit.

The antitheft system according to this embodiment comprises an antitheft gate 3 and an alarm unit 2 which are the same as those of the prior art shown in FIGS. 9 and 10 in construction. The antitheft gate 3 is installed in the vicinity of an exit 30 of a store, and the alarm unit 2 is attached to a commodity on display in the store.

Figure 1:
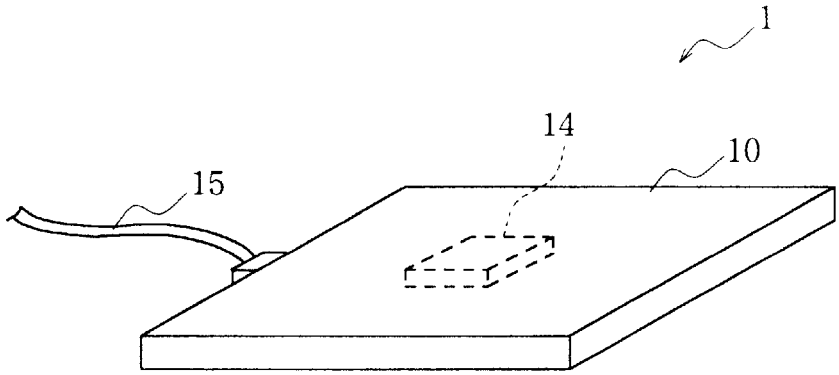
FIG. 1 is a perspective view showing the appearance of a signal generator of the invention.

On the other hand, a signal generator 1 embodying the invention is provided at a cashier's counter where the clerk hands commodities to the customer in exchange for money. As shown in FIG. 1, the signal generator 1 comprises a flat casing 10 and a circuit board 14 housed in the casing. Extending from the casing 10 is a power supply cord 15 for connecting to a receptacle of the commercial power supply.

Figure 2:
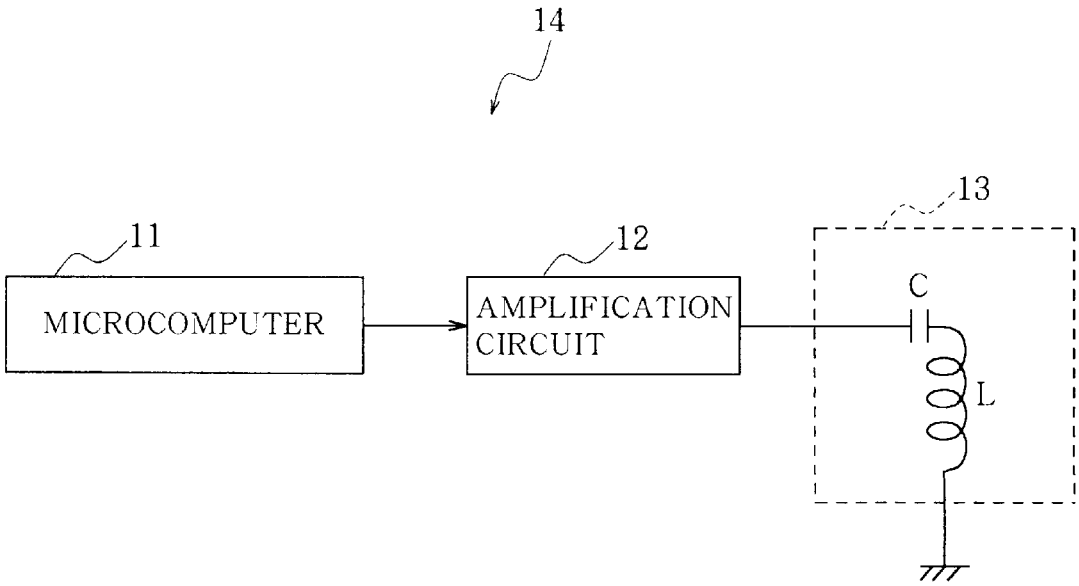
FIG. 2 is a block diagram showing the circuit construction of the signal generator.

FIG. 2 shows the construction of the circuit board 14 incorporated in the signal generator 1. Provided on the circuit board 14 is a transmitting antenna 13 comprising a capacitor C and a coil L. The antenna 13 is connected to a microcomputer 11 via an amplification circuit 12. The microcomputer 11 and the amplification circuit 12 receive power from the commercial power supply 7 by way of the cord 15.

Figure 3:
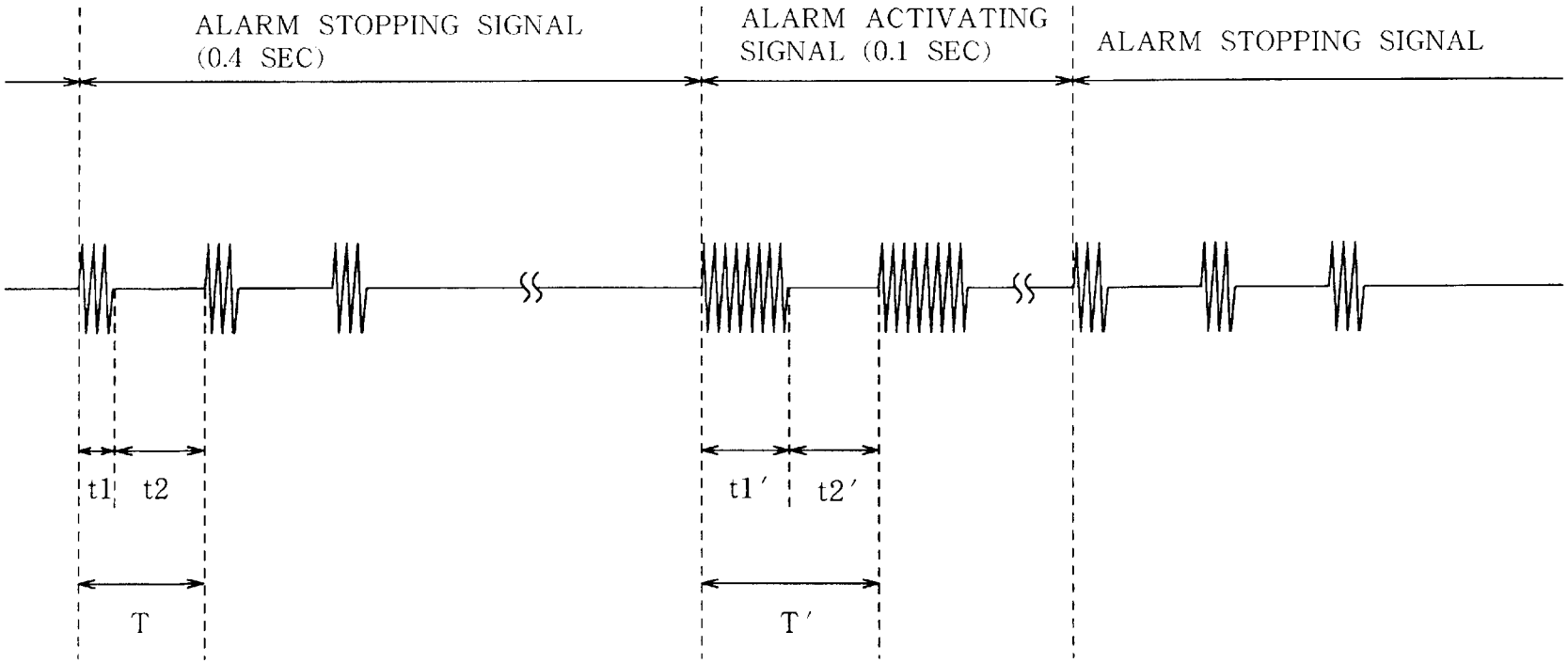
FIG. 3 is a waveform diagram showing an alarm activating signal and an alarm stop signal which are produced by the generator.

With reference to FIG. 3, the microcomputer 11 produces a composite signal including alarm activating signals and alarm stopping signals which appear alternately. The alarm activating signal and the alarm stopping signal each comprise a burst wave of specified pattern (37.5 kHz). The alarm activating signal has an on period of 0.1 sec, and the alarm stopping signal an on period of 0.4 sec.

The alarm activating signal has a period T' comprising a signal period t1' (1453 microsec) and a no-signal period t2' (1453 microsec) which are in a specified ratio. On the other hand, the alarm stopping signal has a period T comprising a signal period t1 (360 microsec) and a no-signal period t2 (1453 microsec) which are in a specified ratio different from the above-mentioned ratio of the alarm activating signal.

The composite signal output from the microcomputer 11 is sent to the amplification circuit 12 as seen in FIG. 2, amplified, fed to the transmitting antenna 13 and sent out as converted to electromagnetic waves.

With reference to FIG. 9, on the other hand, an alarm activating signal which is the same as the alarm activating signal constituting the composite signal is transmitted from a transmitting circuit (not shown) on a circuit board 31 incorporated in the antitheft gate 3.

Figure 4:
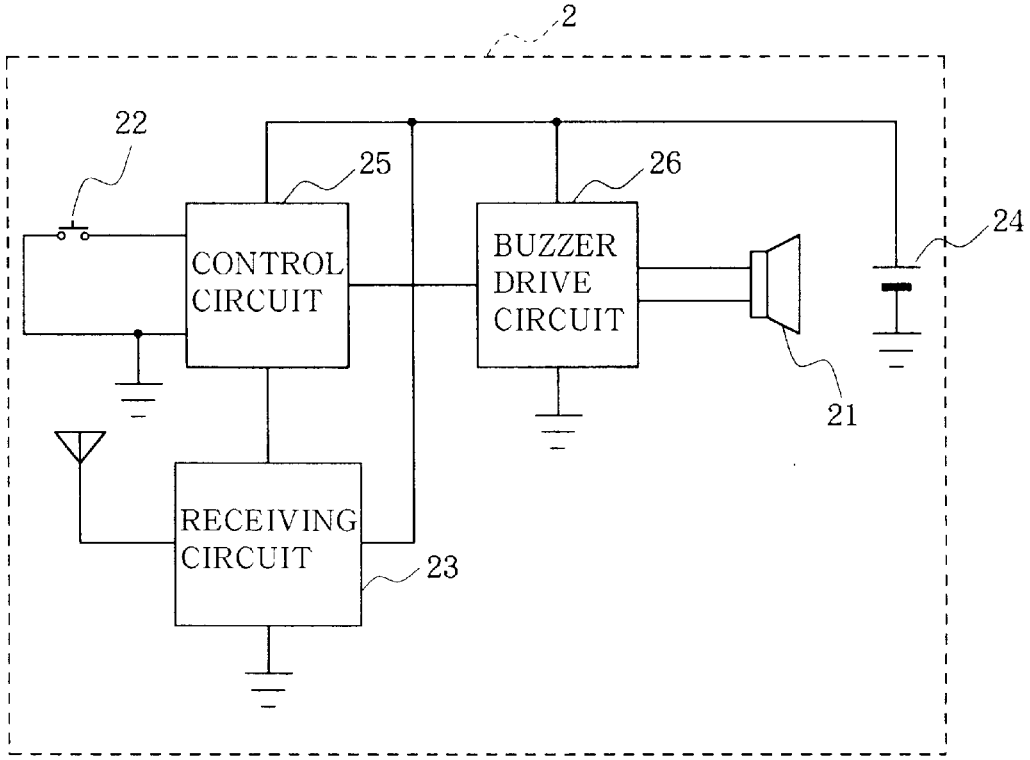
FIG. 4 is a block diagram showing the circuit construction of an alarm unit of the invention.

As shown in FIG. 4, the alarm unit 2 comprises a buzzer 21, alarm actuating switch piece 22, receiving circuit 23, battery 24, control circuit 25 and buzzer drive circuit 26.

The control circuit 25 recognizes the closed state of the switch piece 22 as "on," and the open state thereof as "off." The control circuit 25 prepares a control signal for operating the buzzer 21 when recognizing the off state upon opening of the switch piece 22.

The control circuit 25 receives a signal received by the receiving circuit 23 and checks whether the input signal is an alarm activating signal, and further whether it is an alarm stopping signal. The control circuit 25 identifies the alarm activating signal and the alarm stopping signal as distinguished from each other according to the ratio between the signal period t1' and the no-signal period t2' involved in the period T' of the alarm activating signal shown in FIG. 3, and the ratio between the signal period t1 and the no-signal period t2 involved in the period T of the alarm stopping signal shown.

When recognizing the input signal as the alarm activating signal, the control circuit 25 prepares a control signal for operating the buzzer 21, while when recognizing the input signal as the alarm stopping signal, the control circuit 25 prepares a control signal for bring the buzzer 21 out of operation.

The control signal thus prepared by the control circuit 25 is fed to the buzzer drive circuit 26, which in turn supplies a drive current to the buzzer 21 or discontinues the supply of drive current. The buzzer 21 is energized to give off an alarm or deenergized to stop producing the alarm.

The alarm unit 2 is alternatively settable or resettable. In the set state, the alarm unit 2 produces an alarm upon the switch piece 22 moving to the off position or upon receiving an alarm activating signal. In the reset state, the unit forcibly discontinues the production of the alarm when the switch piece 22 is off and when receiving the alarm activating signal.

Figure 5:
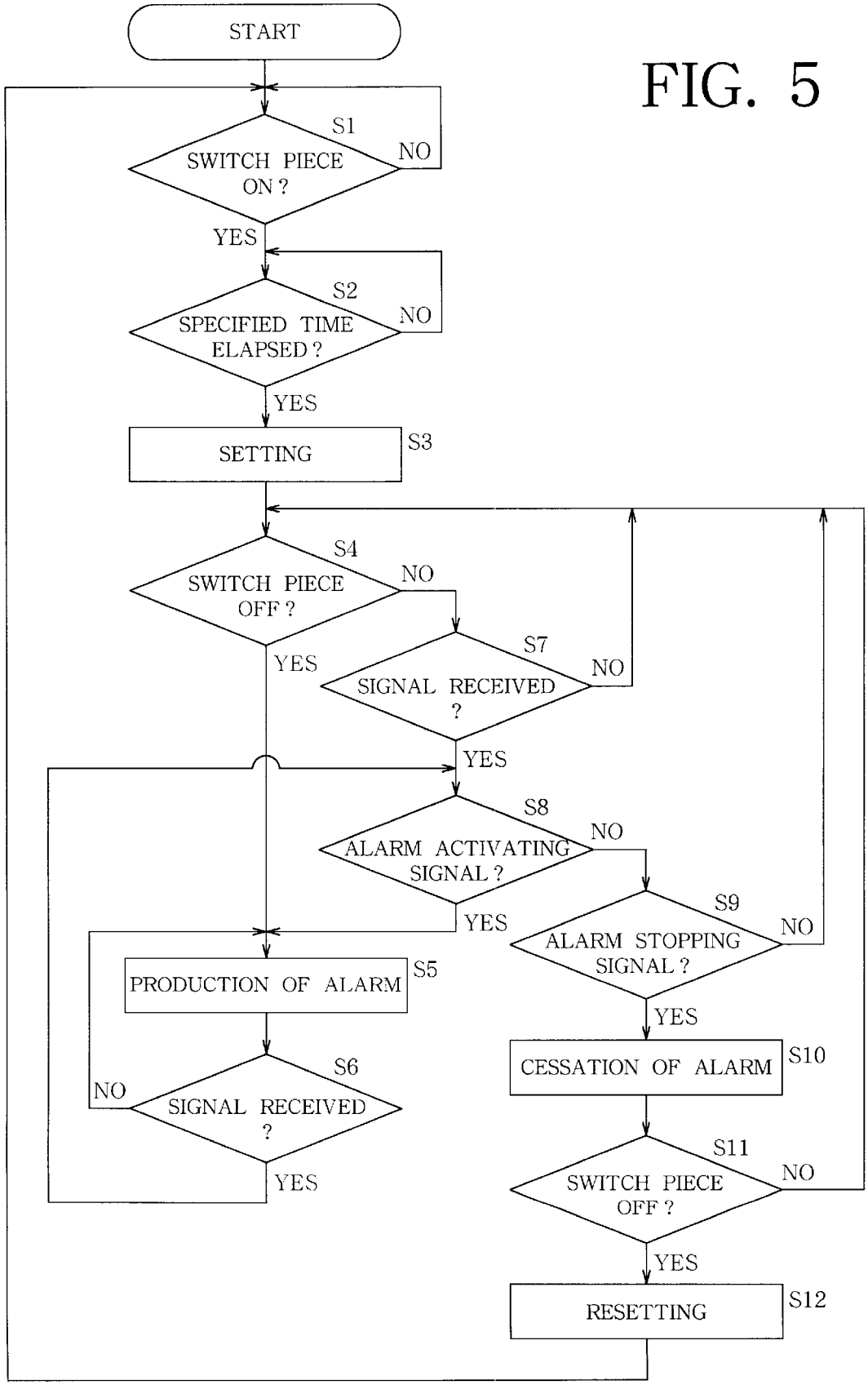
FIG. 5 is a flow chart showing the control procedure to be executed by the control circuit of a first embodiment of the invention.

FIG. 5 shows the control procedure to be performed by the control circuit 25.

First, an inquiry is made in step S1 as to whether the switch piece 22 is on. If the alarm unit 2 is attached to a commodity, the answer is affirmative, followed by step S2. If the alarm unit is not attached to a commodity, the answer is negative, and the inquiry of step S1 is repeated.

Step S2 inquires whether a predetermined period of time has elapsed after the closing of the switch piece 22. Until the time period elapses, the inquiry is answered in the negative, and the inquiry of step S2 is repeated. Upon lapse of the predetermined period of time, the inquiry is answered in the affirmative, followed by step S3, in which the unit is changed from the reset state to the set state.

An inquiry is then made in step S4 as to whether the switch piece 22 is off. The answer is affirmative if the commodity is unlawfully removed from the alarm unit 2. Step S5 follows to give an alarm. An inquiry is made in step S6 as to whether the receiving circuit 23 receives some signal. When the answer is NO, the sequence returns to step S5 for continued production of the alarm. If the inquiry is answered in the affirmative in step S6, step S8 follows.

When the answer to the inquiry of step S4 is negative, step S7 follows to inquire whether the receiving circuit receives some signal. When the answer is negative, the sequence returns to step S4. If the answer is affirmative, step S8 follows.

Step S8 inquires whether the signal from the receiving circuit 23 is an alarm activating signal from the signal generator 1 or antitheft gate 3. The answer is YES when the commodity having the alarm unit 2 attached thereto is then in the hands of the clerk at the cashier's counter, or when the unit 2 has passed by the antitheft gate 3. Step S5 then follows to give an alarm.

If the answer to the inquiry of step S8 is NO, on the other hand, step S9 follows to inquire whether the signal from the receiving circuit 23 is an alarm stopping signal from the signal generator 1. When the commodity having the alarm unit 2 attached thereto is then in the hands of the clerk at the cashier's counter, the answer is YES, followed by step S10, whereas if the inquiry of step S9 is answered in the negative, the sequence returns to step S4.

Step S10 deenergizes the alarm, followed by step S11 to inquire whether the switch piece 22 is off. An affirmative answer is given when the clerk at the cashier's counter has removed the unit 2 from the commodity, followed by step S12, in which the alarm unit 2 is changed over from the set state to the reset state. The sequence thereafter returns to step S1. If the inquiry of step S11 is answered in the negative, step S4 follows.

Basic Operation

When duly purchasing a commodity, the customer hands the commodity to the clerk at the cashier's counter with an alarm unit 2 attached thereto. The alarm unit 2 then receives from the signal generator 1 a composite signal comprising alternating alarm activating signals and alarm stopping signals as seen in FIG. 6(*a*).

When the alarm unit 2 receives the alarm activating signal, the inquiry of FIG. 5, step S8 is answered in the affirmative, followed by step S5, in which the unit 2 gives an alarm. During the period of receiving the alarm activating signal, the inquiry of step S8 is answered in the affirmative for the alarm unit 2 to continue the production of the alarm. When the unit 2 thereafter receives the alarm stopping signal, a negative answer is given in step S8, followed by step S9 which gives an affirmative answer. The sequence proceeds to step S10, in which the alarm unit 2 deactivates the alarm. During the period of receiving the alarm stopping signal, the affirmative answer given in step S9 holds the alarm stopped.

Figure 6:
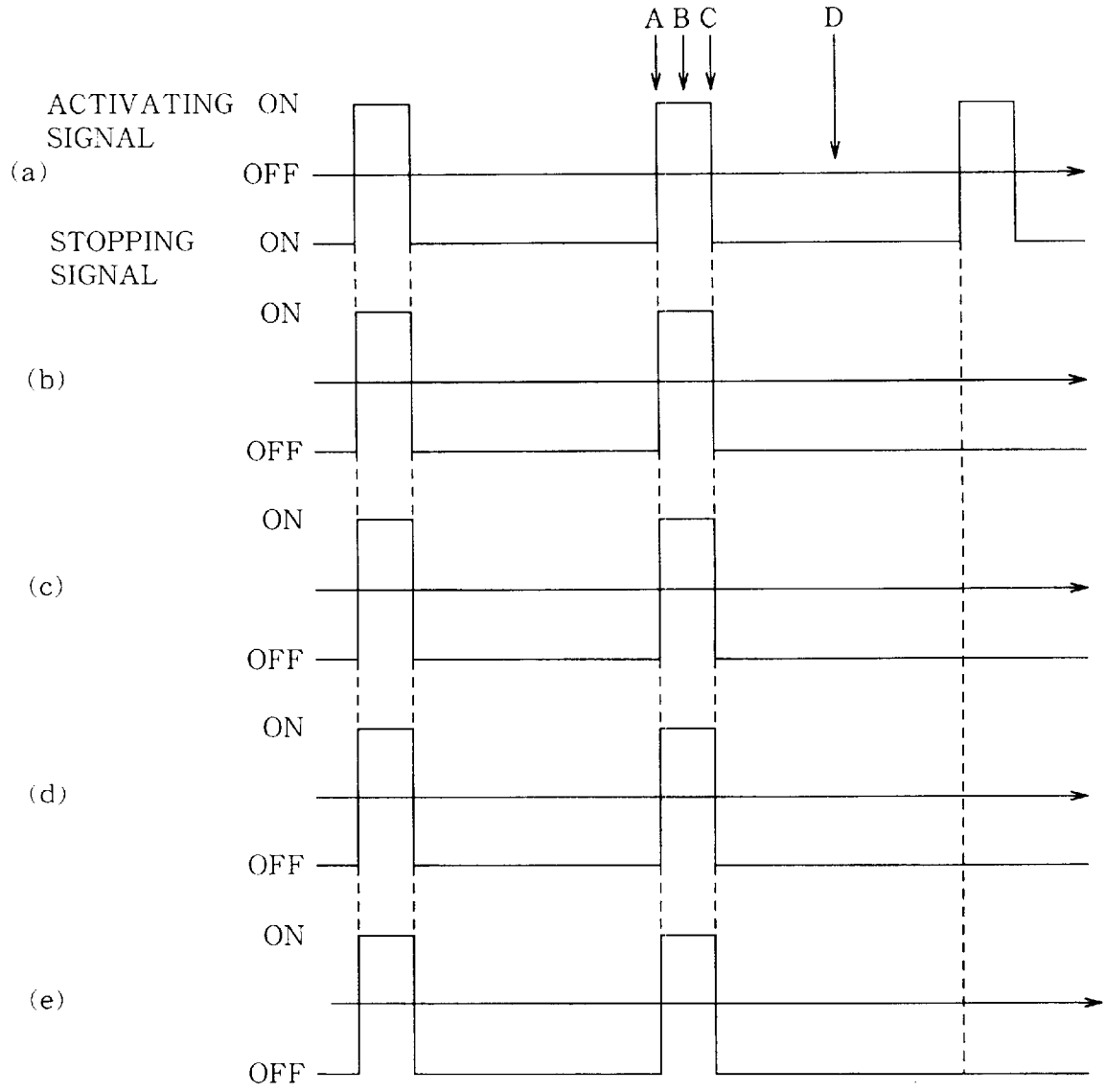
FIG. 6 is a time chart showing an alarm operation when the clerk removes the alarm unit from a commodity at a cashier's counter.

In this way, the alarm unit 2 repeatedly receives alternating alarm activating signals and alarm stopping signals to repeat production of alarm and halting of alarm, consequently giving an intermittent alarm as shown in FIG. 6(*b*).

During the process in which alarm activating signals and alarm stopping signals are input alternately to intermittently give an alarm, the clerk removes the alarm unit 2 from the commodity. The operation to be then performed will be described for different cases.

Case 1

In the case where the clerk removes the alarm unit 2 from the commodity upon a change-over from the alarm stopping signal to the alarm activating signal as indicated by the arrow A in FIG. 6(*a*), step S4 in FIG. 5 gives an affirmative answer, whereupon the sequence proceeds to step S5 to produce an alarm as in the basic operation described. During the subsequent period in which the alarm activating signal is on, the inquiry of step S8 is answered in the affirmative for the unit 2 to continue the production of the alarm as shown in FIG. 6(*a*). Subsequently, upon a change-over from the alarm activating signal to the alarm stopping signal as indicated by the arrow C, step S8 affords a negative answer, followed by step S9 to give an affirmative answer and then by step S10, in which the alarm unit 2 stops producing the alarm as shown in FIG. 6(*b*). Step S11 then gives an affirmative answer, followed by step S12, in which the alarm unit 2 is changed over from the set state to the reset state. Step S1 thereafter gives a negative answer, and this answer is repeated. Thus, resetting the unit 2 at the time indicated by the arrow C forcibly stops the production of alarm irrespective of the state of the alarm actuating switch piece 22 and despite the input of alarm activating signal.

Case 2

In the case where the clerk removes the alarm unit 2 from the commodity at the time of arrow B in FIG. 6(*a*) while the unit is receiving the alarm activating signal, step S8 of FIG. 5 continuously gives an affirmative answer for the unit 2 to continue the production of the alarm as shown in FIG. 6(*c*). Upon a change-over from the alarm activating signal to the alarm stopping signal as indicated by the arrow C, the same procedure as in Case 1 described follows to reset the unit, thereafter forcibly stopping the production of alarm irrespective of the state of the alarm actuating switch piece 22 and despite the input of alarm activating signal.

Case 3

In the case where the clerk removes the alarm unit 2 from the commodity upon a change-over from the alarm activating signal to the alarm stopping signal as indicated by the arrow C in FIG. 6(*a*), step S8 in FIG. 5 gives a negative answer, followed by step S9 which gives an affirmative answer, whereupon the sequence proceeds to step S10 for the alarm unit 2 stop producing the alarm as shown in FIG. 6(*d*). Subsequently, the same procedure as in Case 1 described is executed to reset the unit 2, thereafter forcibly stopping the production of alarm irrespective of the state of the alarm actuating switch piece 22 and despite the input of alarm activating signal.

Case 4

In the case where the clerk removes the alarm unit 2 from the commodity at the time of arrow D in FIG. 6(*a*) while the unit is receiving the alarm stopping signal, step S9 of FIG. 5 continuously gives an affirmative answer for the unit 2 to hold the alarm stopped as shown in FIG. 6(*e*). Subsequently, the same procedure as in Case 1 described follows to reset the unit, thereafter forcibly stopping the production of alarm irrespective of the state of the alarm actuating switch piece 22 and despite the input of alarm activating signal.

As in the basic operation described above, an alarm is intermittently produced by the clerk receiving the commodity with the alarm unit 2 attached thereto, so that by being urged by this alarm, the clerk reliably removes the alarm unit 2 from the commodity. This eliminates the likelihood that the rightful customer will be given an alarm when moving past the antitheft gate 3.

Further as in Case 1 to Case 4 described above, the alarm unit 2 forcibly ceases the production of alarm upon receiving an alarm activating signal from the signal generator 1 regardless of the timing at which the clerk removes the alarm unit 2 from the commodity. This obviates the drawback that a sustained alarm will be produced.

Second Embodiment

The antitheft system of this embodiment, like the first embodiment, comprises an antitheft gate 3, alarm unit 6 and signal generator 4. The antitheft gate 3 has exactly the same construction as the gate of the first embodiment.

The signal generator 4 of this embodiment comprises a microcomputer 41 different from that of the first embodiment in function. The second embodiment, except for the microcomputer 41, has the same construction as the first embodiment shown in FIG. 2 and therefore will not be described repeatedly.

The microcomputer 41 of the present embodiment prepares an intermittent sound generating signal for causing the alarm unit 6 to produce an alarm intermittently as will be described below, and feeds the signal to an amplification circuit 12. The intermittent sound generating signal fed to the circuit 12 is amplified, sent to a transmitting antenna 13 and sent out as converted to electromagnetic waves.

On the other hand, the alarm unit 6 of this embodiment comprises a control circuit 65 different from that of the first embodiment in function. Except for this circuit 65, the alarm unit 6 has the same construction as the unit 2 of the first embodiment shown in FIG. 4 and therefore will not be described repeatedly.

The control circuit 65 of this embodiment checks whether the signal input from a receiving circuit 23 is an alarm activating signal from the antitheft gate 3, and further checks whether the input signal is the intermittent sound generating signal from the signal generator 4. When the input signal is found to be the alarm activating signal, the circuit 65 prepares a control signal for operating a buzzer 21 and feeds the control signal to a buzzer drive circuit 26. If the input signal is found to be the intermittent sound generating signal, on the other hand, the control circuit 65 prepares a control signal for operating the buzzer 21, feeds the signal to the buzzer drive circuit 26, thereafter prepares a control signal for ceasing the operation of the buzzer 21 and feeds this signal to the buzzer drive circuit 26.

Figure 7:
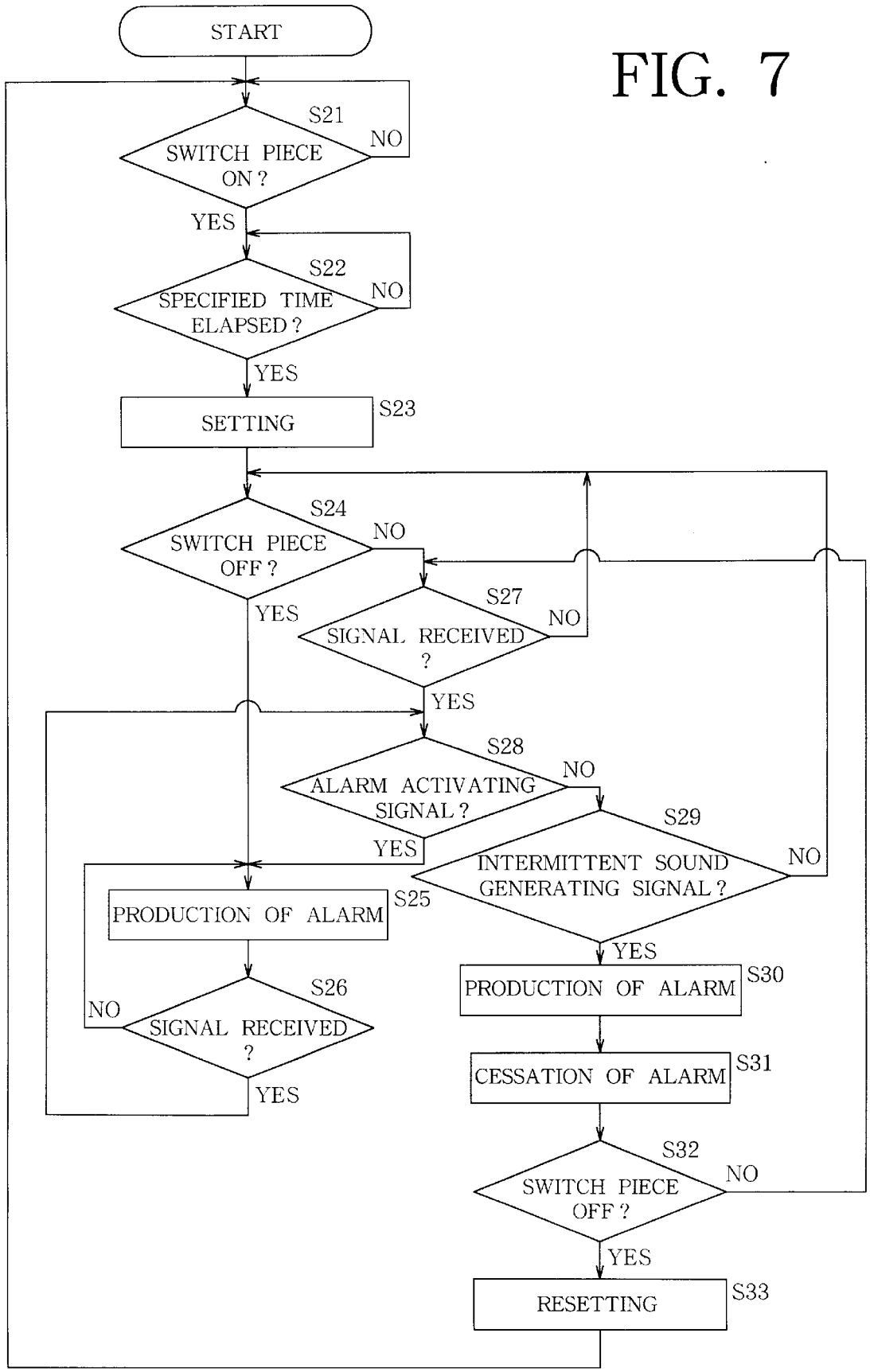
FIG. 7 is a flow chart showing the control procedure to be executed by the control circuit of a second embodiment of the invention.

FIG. 7 shows the control procedure to be performed by the control circuit 65.

An inquiry is first made in step S21 as to whether an alarm actuating switch piece 22 is on. If the answer is affirmative, step S22 follows, whereas when the answer is negative, step S21 is repeated for checking.

Step S22 inquires whether the switch piece 22 remains on for more than a predetermined period of time. When the answer is affirmative, step S23 follows to change over the unit 6 from the reset state to the set state, whereas if the answer is negative, step S22 is repeated for checking.

Step S24 inquires whether the switch piece 22 is off. If the answer is affirmative, with the alarm unit 6 wrongfully removed from the commodity, step S25 follows to give an alarm. Step S26 subsequently inquires whether the receiving circuit 23 has received some signal. When the answer is negative, the sequence returns to step S25 for continued production of the alarm. If the inquiry of step S26 is answered in the affirmative, step S28 follows.

When the inquiry of step S24 is answered in the negative, on the other hand, step S27 follows to inquire whether some signal has been received from the receiving circuit 23. If the answer is negative, the sequence returns to step S24, whereas if the answer is affirmative, step S28 follows.

An inquiry is made in step S28 as to whether the signal from the receiving circuit 23 is an alarm activating signal from the antitheft gate 3. An affirmative answer is given if the unit 6 is moved past the gate 3, followed by step S25 to emit an alarm.

If the inquiry of step S28 is answered in the negative, on the other hand, step S29 follows to inquire whether the signal from the circuit 23 is the intermittent sound generating signal from the signal generator 4. An affirmative answer is given when the commodity with the alarm unit 6 attached thereto is in the hands of the clerk at the cashier's counter, followed by step S30. If step S29 provides a negative answer, the sequence returns to step S24.

An alarm is given in step S30 and then discontinued in step S31.

An inquiry is made in step S32 as to whether the switch piece 22 is off. An affirmative answer is given when the clerk at the cashier's counter removes the unit 6 from the commodity, followed by step S33 for a change-over from the set state to the reset state. The sequence thereafter returns to step S21. If the answer to the inquiry of step S32 is negative, step S27 follows again.

The antitheft system of this embodiment is so adapted that when the commodity with the alarm unit 6 attached thereto is handed by the customer to the clerk at the cashier's counter, the alarm unit 6 receives the intermittent sound generating signal from the generator 4.

Upon the alarm unit 6 receiving the intermittent sound generating signal from the generator 4, step S29 of FIG. 7 provides an affirmative answer, followed by step S30, in which the alarm unit 6 gives off an alarm, which is stopped in step S31. With the alarm unit 6 attached to the commodity, the inquiry of step S32 is answered in the negative to repeat the alarming step S30 and the alarm stopping step S31. As a result, an intermittent alarm is emitted. The intermittent alarm thus given enables the clerk to recognize that the alarm unit 6 remains attached to the commodity.

Upon the clerk removing the unit 6 from the commodity, the inquiry of step S32 is answered in the affirmative, followed by step S33, in which the alarm unit 6 is changed over from the set state to the reset state. Subsequently, step S21 provides a negative answer, and this step is repeated. With the alarm unit 6 thus reset, the unit forcibly ceases the production of alarm regardless of the state of the switch piece 22 and despite the input of alarm activating signal and intermittent sound generating signal.

The antitheft system of the present embodiment is so adapted that the production of alarm is forcibly ceased upon the clerk removing the unit 6 from the commodity. This obviates the likelihood that a useless alarm will be produced.

Third Embodiment

This embodiment includes a signal generator 8 which comprises a microcomputer 81 different from those of the first and second embodiments in function. The third embodiment, except for the microcomputer 81, has the same construction as the first embodiment shown in FIG. 2 and therefore will not be described repeatedly.

The microcomputer 81 of the present embodiment prepares a short sound generating signal for causing an alarm unit 9 to produce an alarm for a short period of time only as will be described below, and feeds the signal to an amplification circuit 12. The short sound generating signal fed to the circuit 12 is amplified, then sent to a transmitting antenna 13 and sent out as converted to electromagnetic waves.

On the other hand, the alarm unit 9 of this embodiment comprises a control circuit 95 different from those of the first and second embodiments in function. Except for this circuit 95, the alarm unit 9 has the same construction as the unit 2 of the first embodiment shown in FIG. 4 and therefore will not be described repeatedly.

The control circuit 95 of this embodiment checks whether the signal input from a receiving circuit 23 is an alarm activating signal from an antitheft gate 3, and further checks whether the input signal is the short sound generating signal from the signal generator 8. When the input signal is found to be the alarm activating signal, the circuit 95 prepares a control signal for operating a buzzer 21 and feeds the control signal to a buzzer drive circuit 26. If the input signal is found to be the short sound generating signal, on the other hand, the control circuit 95 prepares a control signal for operating the buzzer 21, feeds the signal to the buzzer drive circuit 26, thereafter prepares a control signal for ceasing the operation of the buzzer 21 and feeds this signal to the buzzer drive circuit 26.

Figure 8:
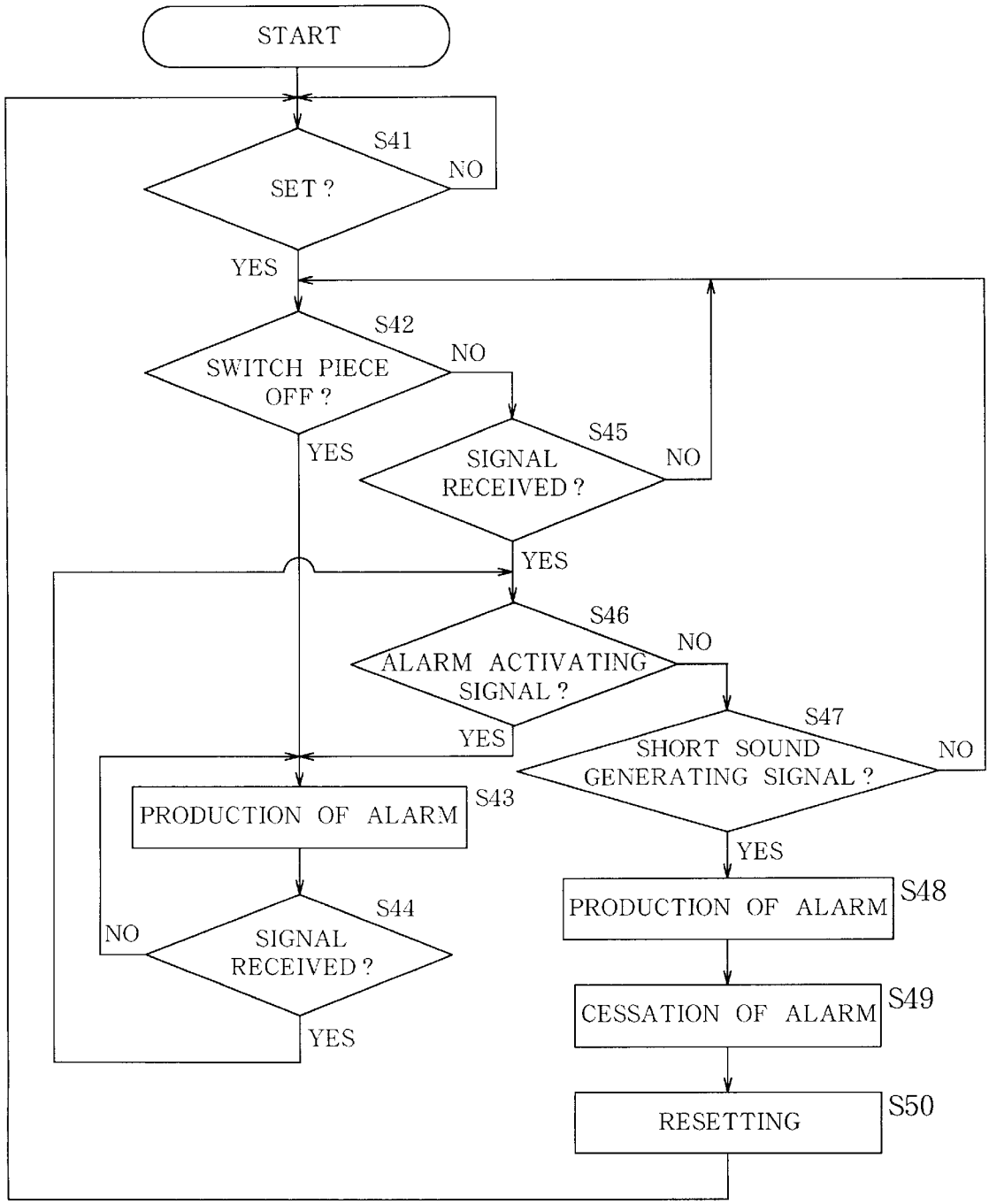
FIG. 8 is a flow chart showing the control procedure to be executed by the control circuit of a third embodiment of the invention.

FIG. 8 shows the control procedure to be performed by the control circuit 95.

First, an inquiry is made in step S41 as to whether the alarm unit 9 is in its set state. If the answer is negative, step S41 is repeated for inquiry.

On the other hand, when the step S41 provides an affirmative answer, step S42 follows to inquire whether an alarm actuating switch piece 22 is off. If the answer is affirmative with the commodity wrongfully removed from the alarm unit 9, step S43 follows to produce an alarm. Subsequently, step S44 inquires whether some signal has been received from the receiving circuit 23. When the answer is negative, the sequence returns to step S43 for continued production of alarm. If the answer to the inquiry of step S44 is affirmative, on the other hand, step S46 follows.

When the inquiry of step S42 is answered in the negative, on the other hand, step S45 follows to inquire whether some signal has been received from the receiving circuit 23. If the answer is negative, the sequence returns to step S42, whereas if the answer is affirmative, step S46 follows.

An inquiry is made in step S46 as to whether the signal from the receiving circuit 23 is an alarm activating signal from the antitheft gate 3. An affirmative answer is given if the unit 9 is moved past the gate 3, followed by step S43 to emit an alarm.

If the inquiry of step S46 is answered in the negative, on the other hand, step S47 follows to inquire whether the signal from the circuit 23 is the short sound generating signal from the signal generator 8. An affirmative answer is given when the commodity with the alarm unit 9 attached thereto is in the hands of the clerk at the cashier's counter, followed by step S48. If step S47 provides a negative answer, the sequence returns to step S42.

An alarm is given in step S48 and then discontinued in step S49. The duration of the alarm is, for example, 0.1 to 1.0 sec.

The alarm unit 9 is changed over from the set state to the reset state in step S50, and the sequence thereafter returns to step S41.

The antitheft system of this embodiment is so adapted that when the commodity with the alarm unit 9 attached thereto is handed by the customer to the clerk at the cashier's counter, the alarm unit 9 receives the short sound generating signal from the generator 8.

Upon the alarm unit 9 receiving the short sound generating signal from the generator 8, step S47 of FIG. 8 provides an affirmative answer, followed by step S48, in which the alarm unit 9 gives off an alarm, which is stopped in step S49. As a result, the alarm is produced for 0.1 to 1.0 sec. The alarm thus produced for a short period of time only enables the clerk to recognize that the alarm unit 9 remains attached to the commodity.

The alarm unit 9 is changed over from the set state to the reset state in step S50. Subsequently, step S41 provides a negative answer, and this step is repeated. With the alarm unit 9 thus reset, the unit forcibly ceases the production of alarm regardless of the state of the switch piece 22 and despite the input of alarm activating signal and short sound generating signal.

The antitheft system of the present embodiment is so adapted that the alarm unit 9 as positioned in the hands of the clerk produces an alarm for 0.1 to 1.0 sec only. Accordingly, the alarm unit 9 is smaller in power consumption and permits the battery to serve for a longer period than the alarm units 2, 6 of the first and second embodiments which continuously produce an intermittent alarm until the clerk removes the unit from the commodity.

The embodiments described above are intended to illustrate the present invention and should not be construed as restricting the invention as set forth in the appended claims or reducing the scope thereof. The system of the invention is not limited to the foregoing embodiments in construction but can of course be modified variously without departing from the spirit of the invention as set forth in the claims.

For example, the on period of the alarm stopping signal is made longer than that of the alarm activating signal according to the first embodiment, whereas the on period of the alarm stopping signal can alternatively be made equal to shorter than the on period of the alarm activating signal.

What is claimed is:

1. An antitheft system comprising an alarm unit to be connected to an article to be prevented from being stolen, and a signal generator for producing a notifying signal, the alarm unit comprising detector means for detecting disconnection of the unit from the article to produce a detection signal, means for receiving the notifying signal, alarm means for producing an alarm, and control means for operating the alarm means upon receiving the detection signal while operating the alarm means upon receiving the notifying signal from the receiving means and thereafter nullifying the detection signal and the notifying signal.

2. An antitheft system comprising an alarm unit to be connected to an article to be prevented from being stolen, and a signal generator for alternately producing alarm activating signals and alarm stopping signals, the alarm unit comprising detector means for detecting disconnection of the unit from the article to produce a detection signal, means for receiving the alarm activating signal and the alarm stopping signal, alarm means for producing an alarm, alarm control means for operating the alarm means upon receiving the detection signal or upon receiving the alarm activating signal from the receiving means while bringing the alarm means out of operation upon receiving the alarm stopping signal from the receiving means, and nullifying means operable upon the alarm control means receiving the detection signal and one of the alarm activating signal and the alarm stopping signal to nullify the subsequent detection signal and alarm activating signal.

3. An antitheft system according to claim 2 wherein upon receiving both the detection signal and the alarm stopping signal, the nullifying means nullifies the subsequent detection signal and alarm activating signal.

4. An antitheft system according to claim 2 wherein the on period of the alarm stopping signal is made longer than the on period of the alarm activating signal.

5. An antitheft system according to claim 2 wherein the nullifying means cancels the nullification of the detection signal and the alarm activating signal when the detection signal remains off for more than a specified period of tire after the nullification of the detection signal and the alarm activating signal.

6. An antitheft system according to claim 3 which further comprises a transmitter provided within an alarming area for transmitting the alarm activating signal to the alarm unit when the unit is being passed through the alarming area.

7. An antitheft system comprising an alarm unit to be connected to an article to be prevented from being stolen, and a signal generator for producing an intermittent sound generating signal, the alarm unit comprising detector means for detecting disconnection of the unit from the article to produce a detection signal, means for receiving the intermittent sound generating signal, alarm means for producing an alarm, alarm control means for continuously operating the alarm means upon receiving the detection signal while intermittently operating the alarm means upon receiving the intermittent sound generating signal from the receiving means, and nullifying means operable upon the alarm control means receiving both the detection signal and the intermittent sound generating signal to nullify the subsequent detection signal and intermittent sound generating signal.

8. An antitheft system according to claim 7 wherein the nullifying means cancels the nullification of the detection signal and the intermittent sound generating signal when the detection signal remains off for more than a specified period of time after the nullification of the detection signal and the intermittent sound generating signal.

9. An antitheft system according to claim 7 which further comprises a transmitter provided within an alarming area for transmitting an alarm activating signal to the alarm unit when the unit is being passed through the alarming area, the alarm control means being operable for continuously operating the alarm means upon receiving the alarm activating signal from the receiving means, the nullifying means being operable upon the alarm control means receiving both the intermittent sound generating signal and the alarm activating signal to nullify the subsequent detection signal, intermittent sound generating signal and alarm activating signal.

10. An antitheft system comprising an alarm unit to he connected to an article to be prevented from being stolen, and a signal generator for producing a short sound generating signal, the alarm unit comprising detector means for detecting disconnection of the unit from the article to produce a detection signal, means for receiving the short sound generating signal, alarm means for producing an alarm, alarm control means for operating the alarm means upon receiving the detection signal, and nullifying means for operating the alarm means only for a predetermined period of time upon receiving the short sound generating signal from the receiving means and thereafter nullifying the subsequent detection signal and short sound generating signal.

11. An antitheft system according to claim 10 wherein the nullifying means cancels the nullification of the detection signal and the short sound generating signal when the detection signal remains off for more than a specified period of time after the nullification of the detection signal and the short sound generating signal.

12. An antitheft system according to claim 10 which further comprises a transmitter provided within an alarming area for transmitting an alarm activating signal to the alarm unit when the unit is being passed through the alarming area, the alarm control means being operable for operating the alarm means upon receiving the alarm activating signal from the receiving means, the nullifying means being operable to operate the alarm means only for a predetermined period of time upon receiving the short sound generating signal from the receiving means and to thereafter nullify the subsequent detection signal, short sound generating signal and alarm activating signal.

* * * * *

UNITED STATES PATENT AND TRADEMARK OFFICE

CERTIFICATE OF CORRECTION

PATENT NO. : 6,043,744
DATED : March 28, 2000
INVENTOR(S) : Matsudaira

It is certified that error appears in the above-indentified patent and that said Letters Patent is hereby corrected as shown below:

column 13 line 58, please delete," tire" and insert -- time

Signed and Sealed this

Tenth Day of April, 2001

*Attest:*

Nicholas P. Godici

NICHOLAS P. GODICI

*Attesting Officer*

*Acting Director of the United States Patent and Trademark Office*